US008747654B2

(12) United States Patent
Ulas Acikgoz et al.

(10) Patent No.: US 8,747,654 B2
(45) Date of Patent: Jun. 10, 2014

(54) PROCESS FOR RECOVERING CATALYTIC PRODUCT

(75) Inventors: Saadet Ulas Acikgoz, Des Plaines, IL (US); Michael A. Schultz, Chicago, IL (US); Xin X. Zhu, Long Grove, IL (US)

(73) Assignee: UOP LLC, Des Plaines, IL (US)

( * ) Notice: Subject to any disclaimer, the term of this patent is extended or adjusted under 35 U.S.C. 154(b) by 519 days.

(21) Appl. No.: 12/960,012

(22) Filed: Dec. 3, 2010

(65) Prior Publication Data

US 2012/0138509 A1 Jun. 7, 2012

(51) Int. Cl.

| | |
|---|---|
| ***C10G 11/18*** | (2006.01) |
| ***C10G 70/04*** | (2006.01) |
| ***B01D 3/14*** | (2006.01) |

(52) U.S. Cl.

USPC ..... 208/101; 208/113; 208/355; 203/42; 203/78

(58) Field of Classification Search

CPC .... C10G 11/18; C10G 70/41; C10G 2400/02; B01D 3/141; B01D 3/143; B01D 53/1493

USPC ..... 208/95, 100–105, 308, 347, 354, 355, 208/113; 196/111, 139; 202/154, 158, 173; 203/42, 71, 78, 81, 87, 98, 99, DIG. 19; 585/800; 95/169, 263; 96/234

See application file for complete search history.

(56) References Cited

U.S. PATENT DOCUMENTS

| | | | | |
|---|---|---|---|---|
| 2,471,134 | A | | 5/1949 | Wright |
| 2,939,834 | A | | 6/1960 | Evans |
| 3,470,084 | A | | 9/1969 | Scott |
| 3,607,734 | A | * | 9/1971 | Stafford, Sr. ..... 208/341 |
| 4,206,038 | A | * | 6/1980 | Smith et al. ..... 208/113 |
| 4,431,529 | A | | 2/1984 | Carson |
| 6,077,985 | A | | 6/2000 | Stork |
| 6,291,734 | B1 | | 9/2001 | Stork |
| 6,395,950 | B1 | | 5/2002 | Rice |
| 6,395,951 | B1 | | 5/2002 | Hamm |
| 6,407,303 | B1 | | 6/2002 | O'Brien et al. |
| 6,472,578 | B1 | | 10/2002 | Rice |
| 6,483,002 | B1 | | 11/2002 | O'Brien |
| 6,540,907 | B1 | | 4/2003 | Towler et al. |
| 6,551,465 | B1 | | 4/2003 | Van Zile et al. |
| 6,558,515 | B1 | | 5/2003 | Steacy |
| 6,645,350 | B1 | | 11/2003 | Steacy |

(Continued)

FOREIGN PATENT DOCUMENTS

WO 2008092232 A1 8/2008

OTHER PUBLICATIONS

Couch, "Concepts for an overall refinery energy solution through novel integration of FCC flue gas power recovery", NPRA Annual Meeting Technical Papers, 2006, pp. 28.

(Continued)

*Primary Examiner* — Nina Bhat
*Assistant Examiner* — Jonathan Miller
(74) *Attorney, Agent, or Firm* — James C Paschall

(57) ABSTRACT

A process is disclosed for recovering product from catalytically converted product streams. An integrated debutanizer column provides an LPG stream, a light naphtha stream and a heavy naphtha stream. The integrated debutanizer column may comprise a dividing wall column. The light naphtha stream may be used as an absorbent for a primary absorber column which provides advantageous operation.

19 Claims, 1 Drawing Sheet

(56) References Cited

U.S. PATENT DOCUMENTS

| | | | | |
|---|---|---|---|---|
| 6,726,835 | B2 | 4/2004 | Towler et al. | |
| 6,927,314 | B1 | 8/2005 | Schultz et al. | |
| 7,128,827 | B2 | 10/2006 | Tallman et al. | |
| 7,267,746 | B1 | 9/2007 | Harris et al. | |
| 7,273,542 | B2 * | 9/2007 | Duhon et al. | 208/106 |
| 7,312,370 | B2 | 12/2007 | Pittman et al. | |
| 7,462,276 | B2 | 12/2008 | Wang et al. | |
| 7,491,315 | B2 | 2/2009 | Eng et al. | |
| 7,611,622 | B2 | 11/2009 | Niccum et al. | |
| 7,686,944 | B2 | 3/2010 | Zhu et al. | |
| 7,714,180 | B2 * | 5/2010 | Duhon et al. | 585/802 |
| 7,795,485 | B2 | 9/2010 | Schultz | |
| 7,795,486 | B2 | 9/2010 | Schultz | |
| 2008/0078692 | A1 | 4/2008 | Wegerer et al. | |
| 2008/0081937 | A1 | 4/2008 | Schultz et al. | |
| 2008/0223754 | A1 | 9/2008 | Subramanian et al. | |
| 2009/0032439 | A1 * | 2/2009 | Couch et al. | 208/95 |
| 2009/0120780 | A1 | 5/2009 | Wegerer et al. | |

OTHER PUBLICATIONS

Linden, "Catalyst deposits in FCCU power recovery systems can be controlled", Oil and Gas Journal, 1986, vol. 84, No. 50, pp. 33-38.

Zhao, "Energy optimization of the process for FCC gasoline olefin reduction", Huaxue Gongcheng/Chemical Engineering (China), 2008, vol. 36, No. 2, pp. 42-45.

Hassan, "Process integration analysis and retrofit suggestions for an FCC plant", Czech Society of Chemical Engineering 13th International Chemical and Process Engineering (Praha Aug. 23-28, 1998) Paper N.F7.4 1P, 1998.

Al-Riyami, "Heat integration retrofit analysis of a heat exchanger network of a fluid catalytic cracking plant", Applied Thermal Engineering, 2001, vol. 21, No. 13-14, pp. 1449-1487.

* cited by examiner

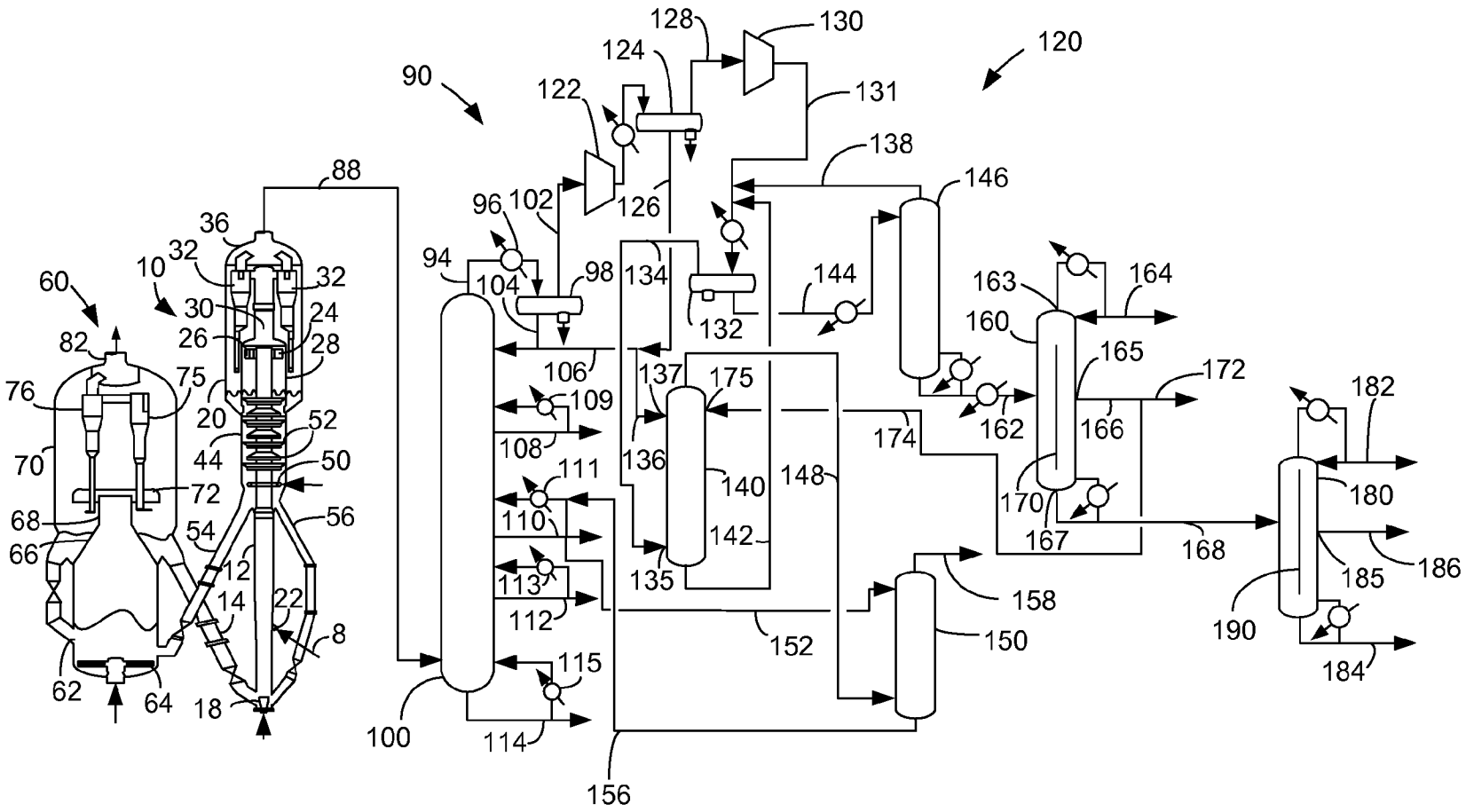
120
90
10
60
8
18
12
14
22
20
44
72
54
56
50
52
28
24
32
36
30
26
75
88
76
70
68
66
62
64
82
94
96
98
100
102
104
106
108
109
110
111
112
113
114
115
122
124
126
128
130
131
132
134
135
136
137
138
140
142
144
146
148
150
152
156
158
160
162
163
164
165
166
167
168
170
172
174
175
180
182
184
185
186
190

PROCESS FOR RECOVERING CATALYTIC PRODUCT

FIELD OF THE INVENTION

This invention generally relates to recovering naphtha product from a catalytic reactor.

DESCRIPTION OF THE RELATED ART

Fluid catalytic cracking (FCC) is a catalytic hydrocarbon conversion process accomplished by contacting heavier hydrocarbons in a fluidized reaction zone with a catalytic particulate material. The reaction in catalytic cracking, as opposed to hydrocracking, is carried out in the absence of substantial added hydrogen or the consumption of hydrogen. As the cracking reaction proceeds substantial amounts of highly carbonaceous material referred to as coke are deposited on the catalyst to provide coked or spent catalyst. Vaporous lighter products are separated from spent catalyst in a reactor vessel. Spent catalyst may be subjected to stripping over an inert gas such as steam to strip entrained hydrocarbonaceous gases from the spent catalyst. A high temperature regeneration with oxygen within a regeneration zone operation burns coke from the spent catalyst which may have been stripped. Various products may be produced from such a process, including a naphtha product and/or a light product such as propylene and/or ethylene.

FCC gaseous products exiting the reactor section typically have a temperature ranging between 482° and 649° C. (900° to 1200° F.). The product stream is introduced into a main fractionation column. Product cuts from the main fractionator column are heat exchanged in a cooler with other streams and pumped back typically into the main column at a tray higher than the pumparound supply tray to cool the contents of the main column. Medium and high pressure steam is typically generated by the heat exchange from the main column pumparounds. Off-gasses from an overhead of the main fractionation column are typically processed in a gas recovery plant to recover valuable lighter products such as fuel gas, liquefied petroleum gas (LPG) and debutanized naphtha. Two types of gas recovery plants include a gas concentration system or a cold box system. A cold box system relies on cryogenic fractionation for product separation. A gas concentration system comprises absorbers and fractionation columns to separate main fractionation column overhead into naphtha and other desired light products. Naphtha present in the main column overhead is processed in the gas recovery section. Typically, a debutanizer column separates liquefied petroleum gas (LPG) from debutanized gasoline. The debutanized gasoline is split into light naphtha and heavy naphtha in a naphtha splitter column downstream of the gas recovery section. If a middle naphtha cut is desired, an additional naphtha splitter column is required to separate a middle naphtha cut from the heavy naphtha cut. If an aromatic naphtha cut is desired, a further naphtha splitter column is required to separate an aromatics-rich naphtha cut from the heavy naphtha stream from which the middle naphtha had been separated. Conventionally, to produce a number of naphtha cuts, one less than the number of splitter columns are required.

The FCC unit makes more steam than it uses, and the amount of energy exported in the form of steam is an important economic consideration in designing an FCC unit. One way of increasing net steam exported from an FCC unit is by improving heat recovery from the FCC main fractionator column and the gas recovery section. The heat recovered from the main fractionator column is a major source of energy for the gas recovery section and some fraction of the total steam exported from the FCC unit.

Dividing wall columns introduced offer about 25-30% improvement in energy and capital savings in comparison to conventional fractionation columns that utilize a direct sequence of one feed stream and two product streams. Some applications of dividing wall columns have been in deethanizer/ethylene fractionation, U.S. Pat. No. 6,077,985; debutanizer/depropanizer columns, U.S. Pat. No. 6,291,734; adsorptive separation processes for separating petrochemicals, U.S. Pat. No. 6,395,950; U.S. Pat. No. 6,395,951; U.S. Pat. No. 6,407,303; U.S. Pat. No. 6,472,578; and U.S. Pat. No. 6,483,002; and fractionation and treatment of full boiling range gasoline U.S. Pat. No. 6,540,907; U.S. Pat. No. 6,726,835; and U.S. Pat. No. 6,927,314. Dividing wall column fractionation trays, control systems and apparatuses have been presented in U.S. Pat. No. 6,551,465; U.S. Pat. No. 6,558,515; U.S. Pat. No. 6,645,350; and U.S. Pat. No. 7,267,746.

Improved apparatuses and processes are desired for recovering valuable products from catalytically produced gases. Such improved apparatuses and processes will be more desirable if they have lower energy requirements.

DEFINITIONS

As used herein, the following terms have the corresponding definitions.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities which may have a reboiler on its bottom and a condenser on its overhead. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the outlet of the column. The bottom temperature is the liquid bottom outlet temperature.

The term "$C_x$−" wherein "x" is an integer means a hydrocarbon stream with hydrocarbons have x and/or less carbon atoms and preferably x and less carbon atoms.

The term "$C_x$+" wherein "x" is an integer means a hydrocarbon stream with hydrocarbons have x and/or more carbon atoms and preferably x and more carbon atoms.

The term "predominant" means a majority, suitably at least 80 wt-% and preferably at least 90 wt-%.

SUMMARY OF THE INVENTION

In a process embodiment, the subject invention involves a catalytic cracking process comprising contacting a hydrocarbon feed with catalyst to provide products. A portion of the products are fractionated in a main fractionation column to provide fractionated products. A liquid stream of the fractionated products is stripped. A stripped liquid stream is fractionated in a debutanizer column to provide an LPG stream, a light naphtha stream and a heavy naphtha stream.

In another process embodiment, the subject invention involves a catalytic cracking process comprising contacting a hydrocarbon feed with catalyst to provide products. A portion of the products are fractionated in a main fractionation column to provide fractionated products. A liquid stream of the fractionated products is stripped. A stripped liquid stream is fractionated in a dividing wall debutanizer column to provide an LPG stream, a light naphtha stream and a heavy naphtha stream.

In a further process embodiment, the subject invention involves a catalytic cracking process comprising contacting a hydrocarbon feed with catalyst to provide products. A portion of the products is fractionated in a main fractionation column to provide fractionated products. A liquid stream of the fractionated products is stripped. Lastly, a stripped liquid stream is fractionated in a dividing wall debutanizer column to provide an LPG stream, a light naphtha stream and a heavy naphtha stream.

BRIEF DESCRIPTION OF THE DRAWING

The FIGURE is a schematic drawing of the present invention.

DETAILED DESCRIPTION OF THE DRAWING

The present invention integrates a debutanizer column and a naphtha splitter column into a single column which may be a dividing wall column in which a vertical partition separates the column sections. The debutanizer feed is introduced at an intermediate stage in the debutanizer column. A sidedraw is taken from the product side of the wall which is concentrated in light naphtha. The bottoms product is concentrated in heavy naphtha which may be further processed in a naphtha splitter to obtain additional naphtha cuts. This naphtha splitter may also be a dividing wall column if more than two additional naphtha cuts are desired. Another feature of this invention is recycling a portion of the light naphtha side draw from the debutanizer column to a primary absorber column to control the recovery of light hydrocarbons. Light naphtha is a more efficient absorbent for light hydrocarbons than conventional naphtha obtained from the bottoms of a debutanizer column. Conventionally, 25 to 50 wt-% of debutanizer bottoms is recycled back to the primary absorber column. By using light naphtha as an absorbent, the amount of recycle can be reduced which impacts the overall energy efficiency of the gas recovery section.

The present invention is a process that may be described with reference to four components shown in the FIGURE: a catalytic reactor 10, a regenerator vessel 60, a product fractionation section 90 and a gas recovery section 120. Many configurations of the present invention are possible, but specific embodiments are presented herein by way of example. All other possible embodiments for carrying out the present invention are considered within the scope of the present invention. For example, if the catalytic reactor 10 is not an FCC reactor, the regenerator vessel 60 may be optional.

A conventional FCC feedstock and higher boiling hydrocarbon feedstock are a suitable feed 8 to the catalytic reactor 10. The most common of such conventional feedstocks is a "vacuum gas oil" (VGO), which is typically a hydrocarbon material having a boiling range of from 343° to 552° C. (650° to 1025° F.) prepared by vacuum fractionation of atmospheric residue. Such a fraction is generally low in coke precursors and heavy metal contamination which can serve to contaminate catalyst. Heavy hydrocarbon feedstocks to which this invention may be applied include heavy bottoms from crude oil, heavy bitumen crude oil, shale oil, tar sand extract, deasphalted residue, products from coal liquefaction, atmospheric and vacuum reduced crudes. Heavy feedstocks for this invention also include mixtures of the above hydrocarbons and the foregoing list is not comprehensive.

The reactor 10 which may be a catalytic or an FCC reactor that includes a reactor riser 12 and a reactor vessel 20. A regenerator catalyst pipe 14 is in upstream communication with the reactor riser 12. The regenerator catalyst pipe 14 delivers regenerated catalyst from the regenerator vessel 60 at a rate regulated by a control valve to the reactor riser 12 through a regenerated catalyst inlet. An optional spent catalyst pipe 56 may deliver spent catalyst from a disengaging vessel 28 at a rate regulated by a control valve to the reactor riser 12 through a spent catalyst inlet. A fluidization medium such as steam from a distributor 18 urges a stream of regenerated catalyst upwardly through the reactor riser 12. At least one feed distributor 22 in upstream communication with the reactor riser 12 injects the hydrocarbon feed 8, preferably with an inert atomizing gas such as steam, across the flowing stream of catalyst particles to distribute hydrocarbon feed to the reactor riser 12. Upon contacting the hydrocarbon feed with catalyst in the reactor riser 12 the heavier hydrocarbon feed cracks to produce lighter gaseous cracked products while conversion coke and contaminant coke precursors are deposited on the catalyst particles to produce spent catalyst.

The reactor vessel 20 is in downstream communication with the reactor riser 12. The resulting mixture of gaseous product hydrocarbons and spent catalyst continues upwardly through the reactor riser 12 and are received in the reactor vessel 20 in which the spent catalyst and gaseous product are separated. A pair of disengaging arms 24 may tangentially and horizontally discharge the mixture of gas and catalyst from a top of the reactor riser 12 through one or more outlet ports 26 (only one is shown) into a disengaging vessel 28 that effects partial separation of gases from the catalyst. A transport conduit 30 carries the hydrocarbon vapors, including stripped hydrocarbons, stripping media and entrained catalyst to one or more cyclones 32 in the reactor vessel 20 which separates spent catalyst from the hydrocarbon gaseous product stream. The disengaging vessel 28 is partially disposed in the reactor vessel 20 and can be considered part of the reactor vessel 20. Gas conduits deliver separated hydrocarbon gaseous streams from the cyclones 32 to a collection plenum 36 in the reactor vessel 20 for passage to a product line 88 via an outlet nozzle and eventually into the product fractionation section 90 for product recovery. Diplegs discharge catalyst from the cyclones 32 into a lower bed in the reactor vessel 20. The catalyst with adsorbed or entrained hydrocarbons may eventually pass from the lower bed into an optional stripping section 44 across ports defined in a wall of the disengaging vessel 28. Catalyst separated in the disengaging vessel 28 may pass directly into the optional stripping section 44 via a bed. A fluidizing distributor 50 delivers inert fluidizing gas, typically steam, to the stripping section 44. The stripping section 44 contains baffles 52 or other equipment to promote contacting between a stripping gas and the catalyst. The stripped spent catalyst leaves the stripping section 44 of the disengaging vessel 28 of the reactor vessel 20 with a lower concentration of entrained or adsorbed hydrocarbons than it had when it entered or if it had not been subjected to stripping.

A first portion of the spent catalyst, preferably stripped, leaves the disengaging vessel 28 of the reactor vessel 20 through a spent catalyst conduit 54 and passes into the regenerator vessel 60 at a rate regulated by a slide valve. The regenerator 60 is in downstream communication with the first reactor 10. A second portion of the spent catalyst is recirculated in recycle conduit 56 back to a base of the riser 12 at a rate regulated by a slide valve to recontact the feed without undergoing regeneration.

The reactor riser 12 can operate at any suitable temperature, and typically operates at a temperature of about 150° to about 580° C., preferably about 520° to about 580° C. at the riser outlet 24. In one exemplary embodiment, a higher riser temperature may be desired, such as no less than about 565° C. at the riser outlet port 24 and a pressure of from about 69 to about 517 kPa (gauge) (10 to 75 psig) but typically less than about 275 kPa (gauge) (40 psig). The catalyst-to-oil ratio, based on the weight of catalyst and feed hydrocarbons entering the bottom of the riser, may range up to 30:1 but is typically between about 4:1 and about 10:1 and may range between 7:1 and 25:1. Hydrogen gas is not added to the riser separate from hydrocarbon feed. Steam may be passed into the reactor riser 12 and reactor vessel 20 equivalent to about 2-35 wt-% of feed. Typically, however, the steam rate may be between about 2 and about 7 wt-% for maximum naphtha production and about 10 to about 15 wt-% for maximum light olefin production. The average residence time of catalyst in the riser may be less than about 5 seconds.

The catalyst in the reactor 10 can be a single catalyst or a mixture of different catalysts. If the catalyst includes a mixture of different catalysts, the catalysts may comprise a first component or catalyst and a second component or catalyst. Such a catalyst mixture is disclosed in, e.g., U.S. Pat. No. 7,312,370. Generally, the first component may include any of the well-known catalysts that are used in the art of FCC, such as an active amorphous clay-type catalyst and/or a high activity, crystalline molecular sieve. Zeolites may be used as molecular sieves in FCC processes. Preferably, the first component includes a large pore zeolite, such as a Y-type zeolite, an active alumina material, a binder material, including either silica or alumina, and an inert filler such as kaolin.

Typically, the zeolitic molecular sieves appropriate for the first component have a large average pore size. Usually, molecular sieves with a large pore size have pores with openings of greater than about 0.7 nm in effective diameter defined by greater than about 10, and typically about 12, member rings. Pore Size Indices of large pores can be above about 31. Suitable large pore zeolite components may include synthetic zeolites such as X and Y zeolites, mordenite and faujasite. A portion of the first component, such as the zeolite, can have any suitable amount of a rare earth metal or rare earth metal oxide.

The second component may include a medium or smaller pore zeolite catalyst, such as an MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. The second component may also include some other active material such as Beta zeolite. These compositions may have a crystalline zeolite content of about 10 to about 50 wt-% or more, and a matrix material content of about 50 to about 90 wt-%. Components containing about 40 wt-% crystalline zeolite material are preferred, and those with greater crystalline zeolite content may be used. Generally, medium and smaller pore zeolites are characterized by having an effective pore opening diameter of less than or equal to about 0.7 nm, rings of about 10 or fewer members, and a Pore Size Index of less than about 31. Preferably, the second catalyst component is an MFI zeolite having a silicon-to-aluminum ratio greater than about 15, preferably greater than about 75. In one exemplary embodiment, the silicon-to-aluminum ratio can be about 15:1 to about 35:1.

The regenerator vessel 60 is in downstream communication with the reactor vessel 20. In the regenerator vessel 60, coke is combusted from the portion of spent catalyst delivered to the regenerator vessel 60 by contact with an oxygen-containing gas such as air to provide regenerated catalyst. The regenerator vessel 60 may be a combustor type of regenerator as shown in the FIGURE, but other regenerator vessels and other flow conditions may be suitable for the present invention. The spent catalyst conduit 54 feeds spent catalyst to a first or lower chamber 62 defined by an outer wall through a spent catalyst inlet. The spent catalyst from the reactor vessel 20 usually contains carbon in an amount of from 0.2 to 2 wt-%, which is present in the form of coke. Although coke is primarily composed of carbon, it may contain from 3 to 12 wt-% hydrogen as well as sulfur and other materials. An oxygen-containing combustion gas, typically air, enters the lower chamber 62 of the regenerator vessel 60 through a conduit and is distributed by a distributor 64. As the combustion gas enters the lower chamber 62, it contacts spent catalyst entering from spent catalyst conduit 54 and lifts the catalyst at a superficial velocity of combustion gas in the lower chamber 62 of perhaps at least 1.1 m/s (3.5 ft/s) under fast fluidized flow conditions. In an embodiment, the lower chamber 62 may have a catalyst density of from 48 to 320 kg/m$^3$ (3 to 20 lb/ft$^3$) and a superficial gas velocity of 1.1 to 2.2 m/s (3.5 to 7 ft/s). The oxygen in the combustion gas contacts the spent catalyst and combusts carbonaceous deposits from the catalyst to at least partially regenerate the catalyst and generate flue gas.

The mixture of catalyst and combustion gas in the lower chamber 62 ascend through a frustoconical transition section 66 to the transport, riser section 68 of the lower chamber 62. The riser section 68 defines a tube which is preferably cylindrical and extends preferably upwardly from the lower chamber 62. The mixture of catalyst and gas travels at a higher superficial gas velocity than in the lower chamber 62. The increased gas velocity is due to the reduced cross-sectional area of the riser section 68 relative to the cross-sectional area of the lower chamber 62 below the transition section 66. Hence, the superficial gas velocity may usually exceed about 2.2 m/s (7 ft/s). The riser section 68 may have a catalyst density of less than about 80 kg/m$^3$ (5 lb/ft$^3$).

The regenerator vessel 60 also may include an upper or second chamber 70. The mixture of catalyst particles and flue gas is discharged from an upper portion of the riser section 68 into the upper chamber 70. Substantially completely regenerated catalyst may exit the top of the transport, riser section 68, but arrangements in which partially regenerated catalyst exits from the lower chamber 62 are also contemplated. Discharge is effected through a disengaging device 72 that separates a majority of the regenerated catalyst from the flue gas. In an embodiment, catalyst and gas flowing up the riser section 68 impact a top elliptical cap of a disengaging device 72 and reverse flow. The catalyst and gas then exit through downwardly directed discharge outlets of the disengaging device 72. The sudden loss of momentum and downward flow reversal cause a majority of the heavier catalyst to fall to the dense catalyst bed and the lighter flue gas and a minor portion of the catalyst still entrained therein to ascend upwardly in the upper chamber 70. Cyclones 75, 76 further separate catalyst from ascending gas and deposits catalyst through diplegs into dense catalyst bed. Flue gas exits the cyclones 75, 76 through a gas conduit and collects in a plenum 82 for passage to an outlet nozzle of regenerator vessel 60 and perhaps into a flue gas or power recovery system (not shown). Catalyst densities in the dense catalyst bed are typically kept within a range of from about 640 to about 960 kg/m$^3$ (40 to 60 lb/ft$^3$). A fluidizing conduit delivers fluidizing gas, typically air, to the dense catalyst bed 74 through a fluidizing distributor. In an embodiment, to accelerate combustion of the coke in the lower chamber 62, hot regenerated catalyst from a dense catalyst bed in the upper chamber 70 may be recirculated into the lower chamber 62 via recycle conduit (not shown).

The regenerator vessel 60 may typically require 14 kg of air per kg of coke removed to obtain complete regeneration. When more catalyst is regenerated, greater amounts of feed may be processed in the reactor 10. The regenerator vessel 60 typically has a temperature of about 594° to about 704° C. (1100° to 1300° F.) in the lower chamber 62 and about 649° to about 760° C. (1200° to 1400° F.) in the upper chamber 70. The regenerated catalyst pipe 14 is in downstream communication with the regenerator vessel 60. Regenerated catalyst from dense catalyst bed is transported through regenerated catalyst pipe 14 from the regenerator vessel 60 back to the reactor riser 12 through the control valve where it again contacts the feed in line 8 as the FCC process continues.

The cracked products in the line 88 from the reactor 10, relatively free of catalyst particles and including the stripping fluid, exit the reactor vessel 20 through the outlet nozzle. The cracked products stream in the line 88 may be subjected to additional treatment to remove fine catalyst particles or to further prepare the stream prior to fractionation. The line 88 transfers the cracked products stream to the product fractionation section 90 that in an embodiment may include a main fractionation column 100 and a gas recovery section 120.

The main column 100 is a fractionation column with trays and/or packing positioned along its height for vapor and liquid to contact and reach equilibrium proportions at tray conditions and a series of pump-arounds to cool the contents of the main column. The main fractionation column is in downstream communication with the reactor 10 and can be operated with an top pressure of about 35 to about 172 kPa (gauge) (5 to 25 psig) and a bottom temperature of about 343° to about 399° C. (650° to 750° F.). In the product recovery section 90, the gaseous products in line 88 are directed to a lower section of a main fractionation column 100. The main fractionation column 100 fractionates the products to provide fractionated products that are withdrawn from the main column 100. In this case, the main column 100 recovers an overhead stream of light products comprising unstabilized naphtha and lighter gases in an overhead line 94. The overhead product stream in overhead line 94 is condensed in a condenser and perhaps cooled in a cooler both represented by 96 before it enters a receiver 98 in downstream communication with the reactor 10. A line 102 withdraws a light off-gas stream of LPG and dry gas from the receiver 98. An aqueous stream is removed from a boot of the receiver 98. A bottoms liquid stream of light unstabilized naphtha leaves the receiver 98 via a line 104. A first portion of the bottoms liquid stream is directed back to an upper portion of the main column and a second portion of unstabilized naphtha in line 106 may optionally be mixed with line 126 and directed in line 136 via inlet 137 as an absorbent to a primary absorber column 140. The light off-gas stream in line 102 may be fed to the gas recovery section 120.

Several other fractionated products may be separated and taken from the main column including an optional heavy naphtha stream in line 108, a light cycle oil (LCO) in line 110, a heavy cycle oil (HCO) stream in line 112, and heavy slurry oil from the bottom in line 114. Portions of any or all of lines 108, 110, 112 and 114 may be recovered while remaining portions may be cooled in heat exchangers 109, 111, 113 and 115, respectively, and pumped back around to the main column 100 to cool the main column typically at a higher entry location. The heat exchangers may use water to cool the product streams for the production of steam or may provide reboiler heat for columns in the gas recovery section 120. The light unstabilized naphtha fraction preferably has an initial boiling point (IBP) below in the $C_5$ range; i.e., below about 35° C. (95° F.), and an end point (EP) at a temperature greater than or equal to about 127° C. (260° F.). The boiling points for these fractions are determined using the procedure known as ASTM D86-82. The heavy naphtha fraction has an IBP at or above about 127° C. (260° F.) and an EP at a temperature above about 200° C. (392° F.), preferably between about 204° and about 221° C. (400° and 430° F.), particularly at about 216° C. (420° F.). The LCO stream has an IBP at about the EP temperature of the heavy naphtha and an EP in a range of about 260° to about 371° C. (500° to 700° F.) and preferably about 288° C. (550° F.). The HCO stream has an IBP of the EP temperature of the LCO stream and an EP in a range of about 371° to about 427° C. (700° to 800° F.), and preferably about 399° C. (750° F.). The heavy slurry oil stream has an IBP of the EP temperature of the HCO stream and includes everything boiling at a higher temperature.

The gas recovery section 120 is shown to be an absorption based system, but any vapor recovery system may be used including a cold box system. To obtain sufficient separation of light gas components, a portion of fractionated products comprising the gaseous stream in line 102 is compressed in a compressor 122, also known as a wet gas compressor, to provide compressed fractionated product. The compressor 122 is in downstream communication with the main fractionation column overhead receiver 98. Any number of compressor stages may be used, but typically dual stage compression is utilized. In dual stage compression, compressed fractionated product from compressor 122 is cooled and enters an interstage compressor receiver 124 in downstream communication with the compressor 122. Liquid in line 126 from a bottom of the compressor receiver 124 may optionally mix with the unstabilized naphtha in line 106 from the main fractionation column overhead receiver 98 and flow together in line 136 via inlet 137 or separately into the primary absorber column 140 in downstream communication with the compressor receiver 124. Gas from the overhead receiver in conduit 128 from a top of the compressor receiver 124 enters a second compressor 130, also known as a wet gas compressor, in downstream communication with the compressor receiver 124 and the main fractionation column 100.

The second compressor 130 compresses a portion of fractionated products which may have been catalytically cracked comprising compressed fractionated product to provide a further compressed fractionated product. Compressed fractionated product from the second compressor 130 in line 131 is cooled and separated into a vapor stream and a liquid stream in the second compressor receiver 132 which is in downstream communication with said second compressor 130. Compressed fractionated product in line 131 may be joined by streams in lines 138 and 142, and they are cooled and fed to a second compressor receiver 132 in downstream communication with the second compressor 130. A vapor stream in a conduit 134 from a top of the second compressor receiver 132 travels to enter a primary absorber column 140 at inlet 135.

The primary absorber column 140 is in downstream communication with conduit 134 extending from a top of the second compressor receiver 132. A liquid stream of the fractionated products in a conduit 144 from a bottom of the second compressor receiver 132 is preheated and travels to a stripper column 146 in downstream communication with the first and second compressors, 122 and 130, respectively, and the conduit 144. The first compression stage compresses gaseous fluids to a pressure of about 345 to about 1034 kPa (gauge) (50 to 150 psig) and preferably about 482 to about 690 kPa (gauge) (70 to 100 psig). The second compression stage compresses gaseous fluids to a pressure of about 1241 to about 2068 kPa (gauge) (180 to 300 psig).

The vapor stream in line 134 fed to the primary absorber column 140 is contacted with unstabilized naphtha in line 136 from the overhead receiver 98 and light naphtha provided by line 174, as will be explained later. The contacting of the vapor stream with naphtha streams effects a separation between $C_3$+ and $C_2$− hydrocarbons by absorption of the heavier hydrocarbons into the naphtha stream upon counter-current contact. The primary absorber column 140 utilizes no condenser or reboiler but may have one or more pump-arounds to cool the materials in the column. The primary absorber column may be operated at a top pressure of about 1034 to about 2068 kPa (gauge) (150 to 300 psig) and a bottom temperature of about 27° to about 66° C. (80° to 150° F.). A predominantly liquid $C_3^+$ stream with some amount of $C_2^-$ material in solution in line 142 from the bottoms of the primary absorber column is returned to line 131 upstream of the condenser to be cooled and returned to the second compressor receiver 132.

An off-gas stream in line 148 from a top of the primary absorber column 140 is directed to a lower end of a secondary or sponge absorber column 150. A circulating stream of LCO in line 152 diverted from line 110 absorbs most of the remaining $C_5$+ material and some $C_3$-$C_4$ material in the off-gas stream in line 148 by counter-current contact. LCO from a bottom of the secondary absorber column in line 156 richer in $C_3^+$ material than the circulating stream in line 152 is returned in line 156 to the main column 90 via the pump-around for line 110. The secondary absorber column 150 may be operated at a top pressure of about 965 to about 2000 kPa (gauge) (140 to 290 psig) just below the pressure of the primary absorber column 140 and a bottom temperature of about 38° to about 66° C. (100° to 150° F.). The overhead of the secondary absorber column 150 comprising dry gas of predominantly $C_2$− hydrocarbons with hydrogen sulfide, amines and hydrogen is removed in line 158 and may be subjected to further separation to recover ethylene and hydrogen.

The liquid stream in conduit 144 extending from a bottom of the second compressor receiver 132 is sent to the stripper column 146. The liquid stream in conduit 144 may be a catalytically cracked product stream. Most of the $C_2$− material in the liquid stream is stripped from the $C_3$-$C_7$ material and removed in an overhead of the stripper column. The overhead gas in line 138 from the stripper column comprising $C_2$− material, LPG and some light naphtha is returned to line 131 without first undergoing condensation. The condenser on line 131 will partially condense the overhead stream from line 138 and the gas compressor discharge in line 131 and with the bottoms stream 142 from the primary absorber column 140 will together undergo vapor-liquid separation in second compressor receiver 132. The stripper column 146 is in downstream communication with the reactor 10, the conduit 144 from the bottom of the second compressor receiver 132, and a bottom of the primary absorber column 140. The stripper column 146 may be run at a pressure above the compressor 130 discharge at about 1379 to about 2206 kPa (gauge) (200 to 320 psig) and a temperature of about 38° to about 149° C. (100° to 300° F.). The stripper column utilizes a reboiler for boiling a portion of the bottoms product and recycling it back to the stripper column 146. The net bottoms product of the stripper column 146 in line 162 is a stripped liquid product stream that is rich in light naphtha.

The FIGURE shows that the stripped liquid product stream from the stripper column 146 is preheated and sent to a debutanizer column 160 via line 162. The debutanizer column 160 is in downstream communication with the reactor 10, a bottom of the second compressor receiver 132, a bottom of the stripper column and the bottom of the primary absorber column 140. The debutanizer column 160 integrates a debutanizer column and a naphtha splitter column into a single column. The integrated debutanizer column 160 may fractionate the stripped liquid product stream, which is a portion of products from the reactor 10, to provide three streams. The debutanizer column 160 provides an LPG stream in line 164 from an overhead outlet 163. The LPG stream may be condensed and a portion refluxed to near a top of the debutanizer column 160, with the net stream providing the LPG stream in line 164. The debutanizer column 160 provides a light naphtha stream in conduit 166, which may be a mid-cut stream, from a side outlet 165. The light naphtha stream may boil between about 25 and about 65° C. The debutanizer column 160 provides a heavy naphtha stream that is provided in conduit 168 from a bottom outlet 167. The heavy naphtha bottoms stream may be split and a portion reboiled and returned to near a bottom of the debutanizer column 160, with the net stream providing the heavy naphtha stream in line 168. The heavy naphtha stream may boil between about 65 and about 200° C.

In an embodiment, the debutanizer column 160 is a dividing wall column to ensure cleaner cuts. In this aspect, a dividing wall 170 is interposed between a feed inlet and a mid-cut side outlet 165 for line 166. The dividing wall has top and bottom ends spaced from respective tops and bottoms of the debutanizer column 160, so fluid can flow over and under the dividing wall 170 from one side to the opposite side.

The light naphtha stream in line 166 may be split between a light naphtha product stream in line 172 and a light naphtha absorbent stream in line 174. The light naphtha absorbent stream may be delivered to the primary absorber column 140 through an inlet 175 at a higher elevation than an inlet 137 of the unstabilized naphtha stream in line 136 and the inlet 135 for conduit 134 from a top of the second compressor receiver 132. The primary absorber column 140 is in downstream communication with the side outlet 165 of the debutanizer column 160. The light naphtha stream from line 174 is contacted with the compressed vaporous product stream from a top of the receiver 132 in the primary absorber column 140. Using light naphtha as an absorbent in the primary absorber column is advantageous over the conventional use of heavy naphtha because the lighter naphtha is more efficient in absorbing $C_3$ and $C_4$'s from the compressed gas fed to the absorber 140 in line 134. Moreover, the light naphtha is lighter than heavy naphtha and requires less heat to boil it. Consequently, the stripper reboiler, the stripper column preheater and the debutanizer column preheater require less heat duty for operation. Moreover, less light naphtha is required to achieve the desired absorption of $C_3$+ hydrocarbons in the primary absorber column 140 than heavy naphtha resulting in less recirculation.

The debutanizer column 160 may be operated at a top pressure of about 1034 to about 1724 kPa (gauge) (150 to 250 psig) and a bottom temperature of about 175° to about 250° C. (347° to 482° F.). The pressure should be maintained as low as possible to maintain reboiler temperature as low as possible while still allowing complete condensation with typical cooling utilities without the need for refrigeration.

The integrated debutanizer column 160 provides a light naphtha stream and a heavy naphtha stream. Conventionally, a debutanizer column and a naphtha splitter column would be necessary to provide these two naphtha streams. If additional naphtha cuts are desired, a naphtha splitter column 180 may be used. The optional naphtha splitter column 180 may split the heavy naphtha in line 168 into a middle naphtha stream and a concentrated heavy gasoline stream.

The naphtha splitter column 180 may be in downstream communication with the integrated debutanizer column 160. The naphtha splitter column 180 may provide a middle naphtha stream in line 182 from the overhead outlet. The middle naphtha stream may be condensed and a portion refluxed to near a top of the naphtha splitter column 180, with the net stream providing the middle naphtha stream in line 182. The middle naphtha stream may boil between about 65 and about 155° C. The naphtha splitter column 180 may provide a concentrated heavy gasoline stream in line 184 from a bottom outlet. The concentrated heavy gasoline bottoms stream may be split and a portion reboiled and returned to near a bottom of the naphtha splitter column 180, with the net stream providing the concentrated heavy gasoline stream in line 184. The concentrated heavy gasoline stream may boil between about 145 and about 200° C.

In an embodiment, if a fourth naphtha cut is desired, the naphtha splitter column 180 may provide an aromatics naphtha stream as a mid-cut stream in line 186, from a side outlet 185. The aromatics naphtha stream is rich in aromatics. If an aromatic naphtha stream is taken, it may boil between about 95 and about 155° C., with the boiling range of the middle naphtha stream between about 65 and about 105° C. and of the concentrated heavy gasoline stream between about 155 and about 200° C. In an embodiment, the naphtha splitter column 180 may be a dividing wall column to ensure cleaner naphtha cuts. A dividing wall 190 may be interposed between a feed inlet and a mid-cut side outlet 185 for line 186. The dividing wall has top and bottom ends spaced from respective tops and bottoms of the naphtha splitter column 180, so fluid can flow over and under the dividing wall 190 from one side to the opposite side.

The naphtha splitter column 180 may be operated at a top pressure of about 69 to about 103 kPa (gauge) (10 to 15 psig) and a bottom temperature of about 150° to about 240° C. (302° to 464° F.).

EXAMPLE

An FCC gas recovery section was simulated with an integrated debutanizer-naphtha splitter column as shown in the FIGURE and with a conventional separate debutanizer column and naphtha splitter column. The estimated yields for the FCC unit are shown in Table 1.

TABLE 1

| Composition | Wt-% | API | Vol-% | Flow rate, BPSD ($m^3$/d) |
|---|---|---|---|---|
| $H_2S$ | 0.03 | — | — | — |
| $C_2$- | 2.38 | — | — | — |
| $C_3$'s | 6.95 | 141.95 | 12.06 | 18,092 (2,876) |
| $C_4$'s | 12.63 | 110.08 | 19.36 | 29,046 (4,618) |
| Gasoline (90% boiling @ 188° C. (370° F.)) | 50.50 | 55.87 | 60.05 | 90,076 (14,321) |
| LCO (90% boiling @ 340° C. (644° F.)) | 16.81 | 19.51 | 16.11 | 24,165 (3,842) |
| Clarified oil | 5.51 | 6.63 | 4.83 | 7,245 (1,152) |
| Coke | 5.19 | — | — | — |

The same product flow rates were obtained from the conventional case and integrated case. The products had the boiling point ranges shown in Table 2.

TABLE 2

| | Conventional Case ASTM CURVE | | Integrated Case ASTM CURVE | |
|---|---|---|---|---|
| PRODUCTS | 10% (° C.) | 90% (° C.) | 10% (° C.) | 90% (° C.) |
| Light Cycle Oil | 228.6 | 327.6 | 228.5 | 327.6 |
| Heavy Catalytic Naphtha | 181.0 | 207.7 | 181.2 | 208 |
| Light Naphtha | 30.6 | 57.8 | 30.8 | 58.7 |
| Middle Naphtha | 72.8 | 98.6 | 70.7 | 99.8 |
| Aromatics Rich Naphtha | 117.9 | 148.1 | 116.8 | 147.8 |
| Heavy Gasoline | 160.3 | 184.6 | 160.6 | 184.7 |

For the Integrated Case a sensitivity study was performed to set the amount of light naphtha recycle and the amount of LCO absorbent required to maintain the $C_3$ and $C_4$ recoveries in the dry gas as low as in the Conventional Case. The amount of light naphtha recycle and LCO flow for the Conventional Case and Integrated Case are as shown in Table 3.

TABLE 3

| | Conventional Case | Integrated Case |
|---|---|---|
| Light Naphtha Recycle to Primary Absorber, kgmol/hr | — | 1219 |
| Heavy Naphtha Recycle to Primary Absorber, kgmol/hr | 1519 | — |
| LCO Flow to Secondary Absorber, kgmol/hr | 427.1 | 735.0 |
| $C_3$ flow in dry gas, kgmol/hr | 15.08 | 15.63 |
| $C_4$ flow in dry gas, kgmol/hr | 4.45 | 4.45 |
| Overall in $C_3$ recovery, % | 98.96 | 98.92 |
| Overall in $C_4$ recovery, % | 99.77 | 99.77 |

The amount of light naphtha recycle from the integrated debutanizer column side cut is significantly less in the Integrated Case than the heavy naphtha cut from the debutanizer bottoms recycled in the conventional case. This reduction affects the overall energy efficiency of the gas recovery section. LCO flow to the secondary absorber column had to be significantly increased to adequately suppress $C_3$ and $C_4$ in the dry gas.

The heating duties for the integrated debutanizer column and the naphtha splitter column(s) in the gas recovery section for the Conventional Case and the Integrated Case are shown in Table 4. The Integrated Case assumes the use of the optional naphtha splitter column to provide three naphtha cuts: middle naphtha, aromatic naphtha and heavy gasoline in addition to the light naphtha produced by the integrated debutanizer column. The Conventional Case uses three naphtha splitter columns to make the same four cuts.

TABLE 4

| Heater | Conventional Case, Gcal/hr | Integrated Case, Gcal/hr |
|---|---|---|
| Debutanizer Reboiler | 46.58 | 53.87 |
| Naphtha Splitter I Reboiler | 21.86 | 22.90 |
| Naphtha Splitter II Reboiler | 20.56 | — |
| Naphtha Splitter III Reboiler | 13.89 | — |
| Stripper Reboiler | 37.77 | 34.87 |
| Debutanizer Feed Preheat | 6.912 | 5.792 |
| Stripper Feed Preheat | 7.58 | 7.179 |
| Total Heating Duty | 155.15 | 124.61 |

Table 4 shows that the debutanizer reboiler duty is substantially greater for the Integrated Case than for the Conventional Case. However, the reboiler duty for the single naphtha splitter in the Integrated Case is substantially less than the duties for three reboilers in the Conventional Case. Moreover, the preheat duties were less in the Integrated Case than in the Conventional Case. Consequently, a 20% reduction in total heating duty results in the Integrated Case.

Operation of the main column was not altered in the Integrated Case from the Conventional Case. No more heat is pulled from main column pump around streams 109, 111, 113 and 115 in the Integrated Case than in the Conventional Case to maintain liquid-to-vapor volume ratios required for fractionation.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated. Additionally, control valves expressed as either open or closed can also be partially opened to allow flow to both alternative lines.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A catalytic cracking process comprising:
- contacting a hydrocarbon feed with catalyst to provide products;
- fractionating a portion of said products in a main fractionation column to provide fractionated products;
- compressing a portion of said fractionated products to provide a compressed, fractionated product;
- separating said compressed, fractionated products into a vapor stream and said liquid stream;
- contacting said vapor stream with at least a portion of a light naphtha stream boiling between about 25 and about 65° C. in an absorber column;
- stripping a liquid stream of said fractionated products; and
- fractionating a stripped liquid stream in a debutanizer column to provide an LPG stream, said light naphtha stream boiling between about 25 and about 65° C. and a heavy naphtha stream.

2. The catalytic cracking process of claim 1 wherein said debutanizer column is a dividing wall column.

3. The catalytic cracking process of claim 1 further comprising splitting said heavy naphtha stream in a naphtha splitter column.

4. The catalytic cracking process of claim 3 wherein said naphtha splitter column provides a middle naphtha stream, an aromatic naphtha stream and a concentrated heavy gasoline stream.

5. The catalytic cracking process of claim 4 wherein said naphtha splitter column is a dividing wall column.

6. The cracking process of claim 1 further comprising regenerating spent catalyst to provide said catalyst.

7. The cracking process of claim 1 further comprising condensing an overhead product stream from said main fractionation column and feeding said condensed overhead product stream to said absorber column.

8. A separation process comprising:
- stripping a catalytically cracked product stream to provide a stripped liquid product stream;
- fractionating said stripped liquid product stream in a debutanizer column to provide an LPG stream, a light naphtha stream boiling between about 25 and about 65° C. and a heavy naphtha stream; and
- contacting said light naphtha stream with a vaporous hydrocarbon stream in an absorber column.

9. The separation process of claim 8 wherein said debutanizer column is a dividing wall column.

10. The separation process of claim 8 further comprising splitting said heavy naphtha stream in a naphtha splitter column.

11. The separation process of claim 10 wherein said naphtha splitter column is a dividing wall column that provides a middle naphtha stream, an aromatic naphtha stream and a concentrated heavy gasoline stream.

12. The separation process of claim 8 further comprising:
- compressing a portion of fractionated catalytically cracked products to provide compressed, fractionated products;
- separating said compressed, fractionated products into a vapor stream and a liquid stream; and
- contacting said vapor stream with at least a portion of said light naphtha stream in an absorber column.

13. A catalytic cracking process comprising:
- contacting a hydrocarbon feed with catalyst to provide products;
- fractionating a portion of said products in a main fractionation column to provide fractionated products;
- contacting a vapor stream of said fractionated products with a light naphtha stream boiling between about 25 and about 65° C. in an absorber column;
- stripping a liquid stream of said fractionated products; and
- fractionating a stripped liquid stream in a dividing wall debutanizer column to provide an LPG stream, said light naphtha stream boiling between about 25 and about 65° C. and a heavy naphtha stream.

14. The catalytic cracking process of claim 13 further comprising splitting said heavy naphtha stream in a naphtha splitter column.

15. The catalytic cracking process of claim 14 wherein said naphtha splitter column provides a middle naphtha stream, an aromatic naphtha stream and a concentrated heavy gasoline stream.

16. The catalytic cracking process of claim 15 wherein said naphtha splitter column is a dividing wall column.

17. The catalytic cracking process of claim 13 further comprising:
- compressing a portion of said fractionated products to provide compressed, fractionated products;
- separating said compressed, fractionated products into said vapor stream and said liquid stream; and
- contacting said vapor stream with at least a portion of said light naphtha stream in said absorber column.

18. The catalytic cracking process of claim 13 further comprising regenerating spent catalyst to provide said catalyst.

19. The catalytic cracking process of claim 13 further comprising condensing an overhead product stream from said main fractionation column and feeding said condensed overhead product stream to said absorber column.

* * * * *